United States Patent [19]

Guenin et al.

[11] Patent Number: 4,720,270

[45] Date of Patent: Jan. 19, 1988

[54] ELECTRIC CONNECTOR WITH A CONTACT ELEMENT OF SHAPE-MEMORY MATERIAL

[75] Inventors: Gérard Guenin, Meyzieu; Guy Herubel, Marly le Roi; Raymond Bargain, Sartrouville; Michel De Mendez, Montlhery, all of France

[73] Assignee: Souriau & Cie, France

[21] Appl. No.: 839,150

[22] Filed: Mar. 13, 1986

[30] Foreign Application Priority Data

Mar. 19, 1985 [FR] France ..... 85 04040

[51] Int. Cl.[4] ..... H01R 13/20

[52] U.S. Cl. ..... 439/161; 439/851; 439/932

[58] Field of Search ..... 439/161, 932, 851, 856, 439/862

[56] References Cited

U.S. PATENT DOCUMENTS

| | | | |
|---|---|---|---|
| 3,861,030 | 1/1975 | Otte et al. | 339/30 |
| 3,906,623 | 9/1975 | Clabburn et al. | 29/628 |
| 3,985,950 | 10/1976 | Maltz | 174/88 C |
| 4,022,519 | 5/1977 | Hill | 339/30 |
| 4,396,244 | 8/1983 | Teman | 439/932 |
| 4,462,651 | 7/1984 | McGaffigan | 439/932 |
| 4,487,465 | 12/1984 | Cherian | 339/30 |
| 4,497,527 | 2/1985 | Cameron | 439/161 |
| 4,621,882 | 11/1986 | Krumme | 439/161 |
| 4,634,201 | 1/1987 | Kemka | 439/161 |

FOREIGN PATENT DOCUMENTS

| | | |
|---|---|---|
| 0081372 | 6/1983 | European Pat. Off. . |
| 0123376 | 6/1984 | European Pat. Off. . |
| 0112618 | 7/1984 | European Pat. Off. . |
| 1327441 | 8/1973 | United Kingdom . |
| 1579734 | 11/1980 | United Kingdom . |
| 2128039A | 4/1984 | United Kingdom . |

OTHER PUBLICATIONS

French Search Report FR 85 04 041.

French Search Report FR 85 04 040.

"Shape Memory Effect, Superelasticity and Damping in Cu-Zn-Al Alloys", Report 78R1, Katholieke Universiteit Leuven, Belgium, by L. Delaey et al., Feb. 1, 1978.

French Search Report FR 85 04 042.

French Search Report FR 85 11 088.

IEEE Transactions on Components, Hybrids and Manufacturing Technology, vol. CHMT-3, Jun. 1980, pp. 226-232, IEEE, New York, U.S.

C. J. Evans, "Connector Finishes, Tin in Place of Gold," p. 226.

*Primary Examiner*—Gil Weidenfeld

*Assistant Examiner*—Paula A. Austin

*Attorney, Agent, or Firm*—Stevens, Davis, Miller & Mosher

[57] ABSTRACT

The invention relates to an electric connector with a contact element of shape-memory material.

The connector has at least one conducting male part and/or a female part intended to be inserted the one into the other for ensuring or breaking electric conduction. One at least of the male or female parts is of a shape-memory conductive material, at least at its active contact end. The male or female part is formed in a manner to enable its tight adaption to the complementary female or male part in a first shape-memory state and to enable ensurance of disengagement of the complementary female or male part in a second shape-memory state.

Application to electric connectors used in electromechanics aeronautical or space electronic installations, information or telematic material.

14 Claims, 8 Drawing Figures

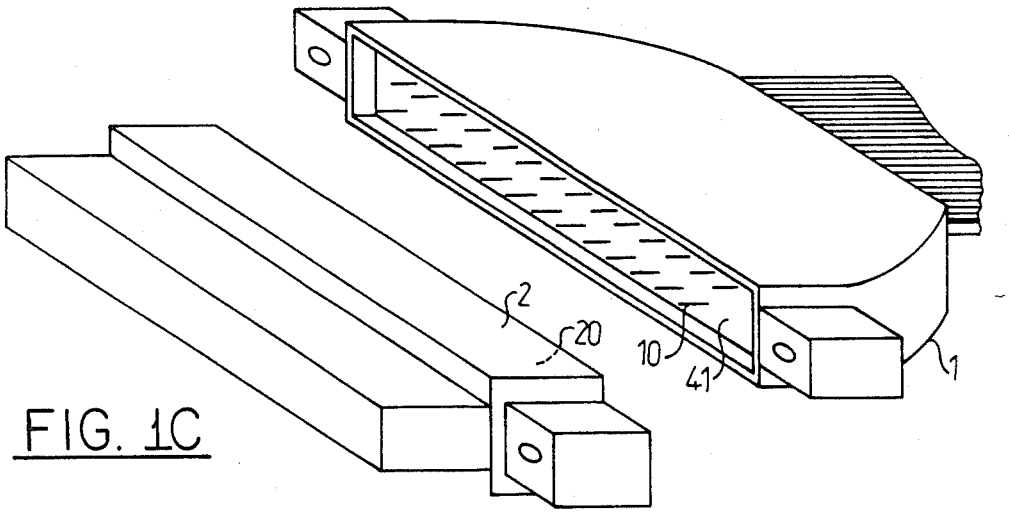
FIG. 1C
FIG. 1A
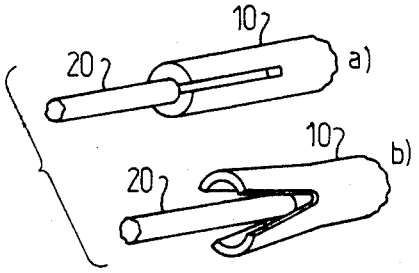
FIG. 1B
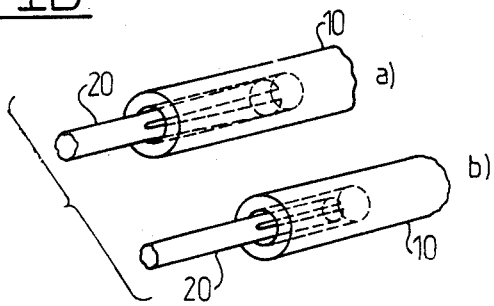

ELECTRIC CONNECTOR WITH A CONTACT ELEMENT OF SHAPE-MEMORY MATERIAL

BACKGROUND OF THE INVENTION

The present invention relates to an electric connector with contact elements of shape-memory material.

In present electric or electronic connectors, the density of connection is a parameter of major significance because of the number, always growing, of electric circuits present in modern electronic or electromechanical assemblies. In consequence it appears that the operational electric connectors have necessarily a significant number of male-female connectible contact elements engaged by friction. The connection-disconnection of this type of connector therefore necessitates the application of significant forces on account of the number of contact elements. The repetition of connection-disconnection operations has the effect of causing a phenomenon of wear on the contact elements and in time the deterioration of the corresponding connectors.

Shape-memory materials have up until now been the object of a few applications in the field of electronics or of the electronic industry for ensuring, particularly, electric connection or disconnection functions.

One can cite on this subject U.S. Pat. No. 4,205,293 in which a thermoelectric commutator is provided by means of a shape-memory material. However, in the device described in this document, as well as in all devices actually known, the connection-disconnection function is ensured by means of conventional contact elements which are brought into action by the intermediary of an actuator element itself only constituted in a shape-memory material and able to participate, only from the mechanical point of view, to the desired connection-disconnection function.

This type of device although able to give satisfaction for devices in which the connection or the disconnection operates on a single or a small number of circuits, can in no case be able to be used in electronic connectors on account of the complexity of their arrangement and/or the often prohibitive congestion of these devices, which cannot permit envisaging of similar densities of connection to the densities of connection currently achieved in the field of electronic connection.

THE INVENTION

An object of the present invention is to remedy the mentioned inconveniences by providing an electric connector permitting ensuring of a significant number of connection-disconnection cycles with a degree of wear of the contact elements greatly attenuated with respect to the known type of connectors or to connectors with a weak insertion force.

Another object of the present invention is to provide a connector as previously mentioned, having a density of connection identical to that having the best performance of presently known materials.

The electric connector of the invention, has at least one conductive male part and/or female part intended to be inserted the one into the other for ensuring or breaking electrical conduction at them. One at least of these male or female parts is of a conductive shape-memory material, at least at its active contact end; the male or female part is formed in a manner to be able to tightly adapt to the complementary female or male part in a first shape-memory state and to be able to ensure disengagement of the said complementary female or male part in a second shape-memory state.

The invention finds application for electric connectors of any type used in the most diverse fields of industrial electronics, electro-mechanics, electronic installations of artificial satellites or of aeronautics information and telematic material.

THE DRAWINGS

The invention will be better understood from reading the following description and studying the drawings in which:

FIG. 1 shows a perspective view of a connector of the invention,

Figure 2:
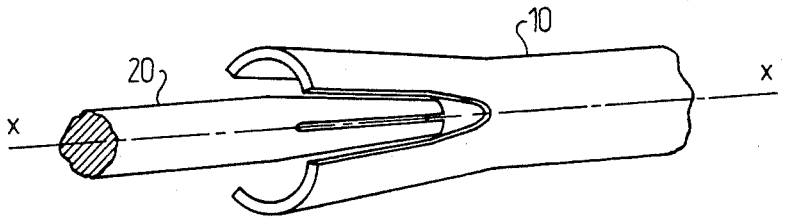
FIG. 2 shows a detail of a particular embodiment of a connector according to the invention.

According to FIG. 1C, the electric connector of the invention has at least a male conductive part 20 and/or a female part 10. These male and female parts are intended to be inserted the one in the other for ensuring or breaking electric conduction at them.

One at least of the said male 20 or female 10 parts is of a conductive shape-memory material, at least at its active contact end. The male 20 or female 10 part is formed in a manner to be able to be tightly adapted to the complementary female 10 or male 20 part in a first shape-memory state and in a manner to be able to ensure the disengagement of the complementary female 10 or male 20 part in a second shape-memory state.

Of course, by connector is intended any connection element having one or two insertable parts designated 1,2 in FIG. 1C, a first insertable part 2 being constituted by a plurality of male parts 20 previously described combined in an arrangement by means of a support plate and of a case or shell constituting the body of the connector, a second insertable part 1 being constituted by a plurality of female parts combined in a similar arrangement by means of a support plate referenced 41 in FIG. 1C and of a case or shell forming the body of the connector.

The connector of the invention permits in the first shape-memory state ensuring very good electrical contact between the male 20 and female 10 parts as well as good mechanical fixing between the male and female parts and hence ensured of the connector. On passage to the second shape-memory state of the male 20 or female 10 parts, the disengagement of the complementary part is ensured and the corresponding contact and the connectors can then be fixed or unfixed with a zero or negligible assembly or disassembly force. As a result, even after a significant number of repeated cycles of connection, there is practically no wear of the contact pieces.

The passage from the first shape-memory state to the second shape-memory state can be effected by modification of the temperature of the connector, that is to say of the male and/or female corresponding part, as will be described in a more detailed manner in the following description. Of course, the first shape-memory state in which the electric contact is ensured is stable at ambient temperature. This first shape-memory state is also stable at low temperature, that is to say at temperatures corresponding to the lowest use temperatures of specifications normally in force for this type of connector. The lowest limit of temperature for which the first shape-memory state remains stable is for example −65° C.

In FIGS. 1A and 1B, is successively shown at 1A the case where the female part 10 is alone made of a shape-memory material, the two states being shown as a and b, then in FIG. 1B the male element 20 is alone made of shape-memory material in these two respective states also shown in a and b. In the two mentioned cases, the complementary element, that is to say the male element 20 in the case of FIG. 1A and the female element 10 in the case of FIG. 1B, can be of a conventional type of conductive materials.

FIG. 2 shows an advantageous non-limitative embodiment in which the male part 20 and the female part 10 are on the one hand reciprocally shaped in a manner to be able to adapt mutually to the complementary female 10 or male 20 part for ensuring electric contact in the first shape-memory state. The male 20 and female 10 parts are further shaped in a manner to enable the assurance of disengagement of the complementary female 10 or male 20 part in the second shape-memory state. In FIG. 2, the male 20 and female 10 parts are shown in the second shape-memory state. It will be noted that each of the male or female parts has, in the first and second memory states, complementary shaped memory states. By complementary shape-memory states, is intended the state or shape obtained by complementary variation of shape. Thus, in the second shape-memory state as shown in FIG. 2, the female part 10 is in a state which is obtained following a spacing of the two constituent parts of the female part 10 whilst on the contrary, the male part 20 is in a state which is obtained by the approach of the male part 20. It will be understood that in such a state, the disengagement and/or insertion of a connector on a cycle of insertion is particularly easy and can be practically carried out without any friction. Also it will be understood that the following passage of these same male 20 and female 10 elements to their first, stable shape-memory state has the effect of ensuring an excellent electric contact due to the reverse movements of the male and female parts and in addition an excellent mechanical fixing of these male 20 and female 10 parts as a result of the forces brought into play by the return to the first stable shape-memory state.

This type of connector, that is to say a connector having male 20 and/or female 10 parts in a complementary shape-memory state is particularly well adapted for uses in hostile mechanical environments, that is to say for example for applications to electro-mechanical systems submitted to significant vibrations, as for example for the connection of electric motor circuits of aeroplanes, boats or the like.

A detailed example of an embodiment of a male or female part will now be given in connection with FIG. 3. The male or female part is constituted by a shank 90 intended to receive at least one conductive cable and by an active part 91 fixed to the shank and constituting the male or female part and intended to ensure the contact on the complementary corresponding female or male part. A collar 92 positioned substantially at the connection between the shank 90 and the active part 91 permits assurance of the fixing of each element or female, or male part in the corresponding support plate, in accordance with known techniques. The active part 91 is constituted by a tubular or cylindrical element 100 having at least along one of its generatrices a slot 101 extending in a tubular part of the element. The slots 101 substantially delimit two flexible blades 102,103 constituting the active part.

Figure 3:
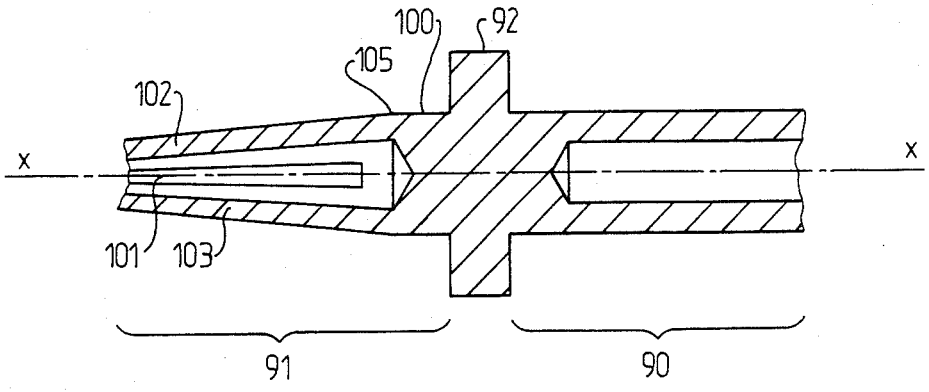
FIG. 3 shows in longitudinal cross-section a particular embodiment of a contact element for a connector according to the invention.

The male, female part previously described in FIG. 3, can be obtained from shape-memory material delivered in the form of a cylindrical ingot or wire by conventional turning and milling. Other types of male or female parts can also be obtained from shape-memory material delivered in the form of sheets, which can be stamped and rolled in a manner to form a cylindrical element having at least one slot. Of course, other shapes of male or female parts can be used without departing from the scope of the present invention. In particular, each tubular or cylindrical element constituting the male or female parts respectively can have similar complementary cross-sections, the slots being arranged symmetrically or not with respect to the longitudinal access of symmetry XX of each tubular element.

Figure 4:
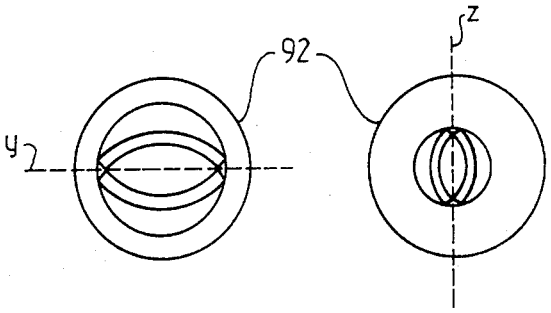
FIGS. 4 and 5 show by way of non-limitative example a particular embodiment of a connector according to the invention.
Figure 5A:
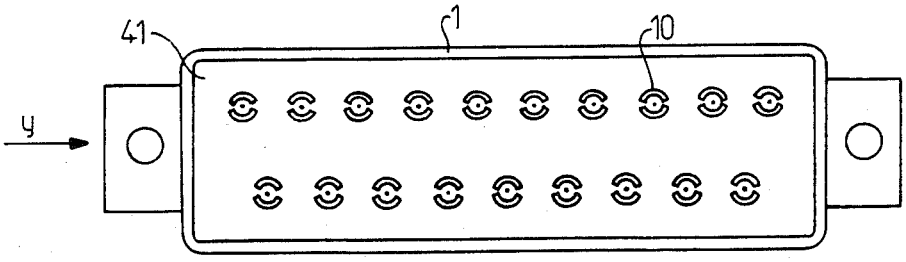
Figure 5B:
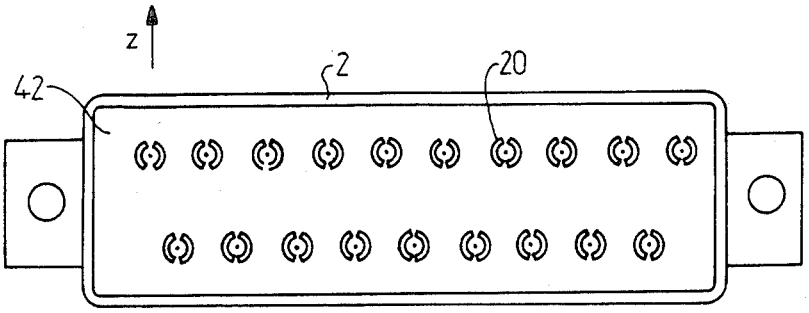

A complete connector will now be described in connection with a non-limitative embodiment by means of FIGS. 4 and 5A and 5B. According to the mentioned Figures, one of the insertable parts constituting an insertable male part 2 is constituted by the male parts 20 combined in a regular arrangement, the diametral plane, passing through two slots of each tubular element, being oriented according to a first direction z appears in FIG. 5*b*. Another insertable part constituting an insertable female part 1 is constituted by the female parts 10 combined in the same regular arrangement. The diametral plane passing through the two slots of each tubular element of the female parts 10 is oriented according to a second direction y as in FIG. 5*a* perpendicular or not to the first direction z for example.

Each of the male 20 or female 10 parts of the connector of the invention, can be entirely made from shape-memory material. In this case, the shank 90 intended to receive at least one conductor cable has also at least one non-reversible shape-memory state. The shank 90 is shaped in a manner to be able to be tightly adapted to the conductive cable in the mentioned shape-memory state, in order to ensure electric connection with the latter. By non-reversible shape-memory state of the shank, should be understood a memorised shape state permitting at least one cycle consisting in a dilation of the bored part of the shank 90, the introduction of a conductor intended to equip the contact, then the return to a position of stable shape in which, in the presence of the conductive cable, electric contact and mechanical fixing of the cable in the shank is ensured. Of course it follows from this that the shank itself can in a non-limitative manner have the reversible shape-memory property.

Examples of shape-memory material, able to be used for providing the connector of the invention will now be given. These materials are, in a non-limitative manner, chosen from the compositions nickel-titanium, nickel-aluminium, nickel-titanium-iron, copper-zinc-aluminium, copper-aluminium-nickel. These compositions can be used either in the form of intermetallic compositions or in alloyed form. By way of non-limitative example, male or female parts such as shown in FIG. 3 have been made from a copper-zinc-aluminium alloy having 4%±0.5% of aluminium, 27 to 29% zinc and balance by percentage of copper, the percentages being atomic percentages. Each male 20 or female 10 part can further be provided with a conductive protective covering consisting of a deposit of gold or silver or an alloy of palladium or even tin lead. This latter cover can in effect be utilised for enlarging the field of normal use since there exists practically no problem of fretting nor of use at each male or female part.

With the embodiment of male or female parts previously described, it is possible to obtain a transition temperature Ms of the order of −80° C. This transition temperature which is the temperature of passage from the martensitic state for the constituent material of the male or female parts, permits ensuring holding of the first stable shape-memory state for the advertised field of use. The second shape-memory state is stable for temperatures lower than this transition temperature. The passage from the first shape-memory state to the second shape-memory state can be brought about in a reversible manner for a significant number of cycles solely by lowering the temperature of the connector, that is to say the male, female parts, below the transition temperature Ms, and then returning to a use temperature above the temperature Ms or vice versa.

An example of treatment of a male 20 or female 10 part such as shown in FIG. 3, will now be described with a view of obtaining the mentioned first and second shape-memory states. The male 20 or female 10 part to be shaped to the final shapes and dimensions constituting the first shape-memory state such as shown for example in FIG. 3. The male 20 or female 10 part is then submitted to a thermal treatment able to bring it to an austenitic type crystallographic phase state. The male 20 or female 10 part is then submitted to a cooling to a temperature close to the ambient temperature, in a manner to avoid the appearance of a parasitic crystallographic phase. By cooling, is intended cooling such as is obtained by means of treatment of the quenching type for example.

The male or female part is then submitted in at least one deformation zone of it, designated 105 in FIG. 3, to a process called education. The process of education consists of imposing repetitively on the male or female part a mechanical stress such that the male or female part is, in this zone, deformed in a manner to bring the blades 102,103 into a shape position close to the region the second shape-memory state, and to submit the assembly, the stress being maintained, to a lowering of temperature able to bring the male or female part into a martensitic phase state. The lowering of temperature can be carried out by means of any source of cold applied either to the entire male or female part or only to the zone or zones of deformation 105. The mechanical stress can be applied for example by means of a tool in the form of a cone permitting opening of the active part to obtain the desired position of shape-memory. After removal of the mechanical stress, the male or female element is submitted to a progressive cooling to the ambient temperature. The male or female element then retakes up its stable shape state or first shape-memory state. The repetition of the imposed cycle for the eduction as previously defined must be sufficient to obtain a good degree of reproduceability of the transitions between the first shape-memory state and the second state subsequently solely by lowering of the temperature of the male or female element to a temperature lower than the transition temperature Ms (defined as the temperature at which the martensitic phase itself starts to be formed) then by a successive raising of the temperature of the male or female part to a temperature greater than the temperature As, for the return to the initial shape-memory position or state and to an austenitic type crystallographic state.

A variant of the process of education will be given by way of non-limitative example in connection with FIG. 3.

The process of education consists of imposing in the absence of deformation the object constituted by the male or female part formed in an initial state, at least at the deformation zone 105 of it, a thermal stress consisting in a variation of temperature able to bring it into the martensitic crystallographic phase state. Then the male or female part being in the mentioned state, a mechanical stress such that the male or female part is deformed, in this zone, is applied in a manner to bring the blades 102,103 into a shape position close to the second shape-memory state II. The lowering of temperature and the application of mechanical stress can be carried out with the aid of means already mentioned, the opening of the active part being carried out until the desired second shape-memory position is obtained. When the cold source is a liquid nitrogen bath, the application of the mechanical stress can be carried out in the bath. Then a so-called intermediary shape state close to the initial shape state of the male or female part is subsequently defined and imposed on it. The imposition of the intermediary shape of state on the male or female part is carried out by the imposition of limits of subsequent change of shape of it to corresponding limits of the intermediary shape state. By intermediary shape state close to the initial shape state is intended a shape state in which the return to the initial state is obtained or a shape close to this. The definition and imposition of limits of change of shape of the male or female part can be carried out by means of a matrix enclosing the male part or of a mandrel inserted in the female part, the matrix or mandrel having respectively internal and external dimensions corresponding to the dimensions of the intermediary shape state.

Of course the matrix or mandrel can advantageously be constituted by the corresponding female or male part. The male or female part, in martensitic state, to which these limits of change of shape have been imposed, is then submitted to progressive reheating to ambient temperature for returning it to an austenitic type crystallographic state. As a result of the reheating and the holding of the male or female part in the intermediary shape state, internal stresses permitting the definition of the intermediary shape state as the first memory-shape state I are then introduced into the male or female element.

A connector has thus been described which is capable, via a single control of temperature, of permitting by modification of shape of the contact elements, the male part or female part, functioning practically without any significant mechanical force and without any wear of the male part or the female part of the contact elements. Control of the temperature of the connector of the invention can be obtained from any source of cold normally available in an industrial environment and in particular by means of liquid nitrogen. The cooling of the connector of the invention below the temperature of transition of the constituent alloy of the male and female parts has the effect of disengaging the corresponding female and male parts placing them in their second shape-memory state, a state in which the connectors can be inserted or on the contrary disconnected with zero or negligble insertion or extraction force. The return to ambient temperature or any temperature in the operating range of the connector has the effect of causing the closure and the adaption for contact of the corresponding male and female parts and of ensuring the requisite fixing force. This can be rendered very significant for specified applications already mentioned.

We claim:

1. An electric connector comprising:

at least one conductive male part or female part intended to be inserted into a respective female part or male part for ensuring or breaking electric conduction between them;

one at least of said male or female parts is of conductive, homogeneous shape-memory material, at least at an active contact end;

said male or female part being shaped in a manner to be able to be tightly adapted to said respective female part or male part in the first shape-memory state and to be able to ensure the zero insertion force disengagement of said respective female part or male part in a second shape-memory state, passage from the first shape-memory state to the second shape-memory state being effected solely by the modification of the temperature of the connector through a reversible shape-memory effect over a plurality of connection-disconnection cycles.

2. An electric connector according to claim 1, wherein said first shape-memory state, in which electric contact is ensured, is stable at ambient temperature.

3. An electric connector according to claim 1, wherein said first shape-memory state, in which electric contact is ensured, is stable at low temperature.

4. An electric connector according to claim 1, wherein said male part and said female part are, on the one hand, reciprocally shaped in a manner to be able to be mutually adapted to said complementary female or male part for ensuring electric contact in a first shape-memory state, and on the other hand, in a manner to be able to ensure disengagement of said complementary female or male part in a second shape-memory state, each of said male or female parts possessing in said first and second memory states, complementary shape-memory states.

5. An electric connector according to claim 1, wherein said male part or female part is constituted by:

a shank intended to receive at least one conductive cable, and an active part, fixed to said shank, constituting said male or female part, and intended to ensure certain contact on said respective female part or male part.

6. An electric connector according to claim 5, wherein said active part is constituted by a tubular or cylindrical element having at least, along one of its generatrices, a slot extending in a part of the length of said tubular element and substantially delimiting two flexible blades constituting said active part.

7. An electric connector according to claim 6 comprising two insertable parts;

a first said insertable part being constituted by a support plate and a plurality of said male parts combined in an arrangement by means of said support plate;

a second said insertable part being constituted by a support plate and a plurality of said female parts combined in a similar arrangement by means of said support plate.

8. An electric connector according to claim 7, each said tubular or cylindrical element constituting said male and female parts respectively has complementary similar sections, said slots being arranged symmetrically or not with respect to the longitudinal axis of symmetry of each tubular element.

9. An electric connector according to claim 8, wherein one of said insertable parts, constituting a male insertable part, is constituted by said male parts combined in a regular arrangement, the diametral plane passing through said two slots of each said tubular element being oriented according to a first direction z, the other said insertable parts, constituting a female insertable part being constituted by said female parts combined in the same regular arrangement, the diametral plane passing through said two slots of each tubular element being oriented according to a second direction y perpendicular or not to said first direction.

10. An electric connector according to claim 1, wherein each said male or female part is entirely made from shape-memory material.

11. An electric connector comprising:

at least one conductive male part or female part intended to be inserted into a respective female part or male part for ensuring a breaking electric conduction between them;

one at least of said male or female parts is of conductive shape memory material, at least at an active contact end;

said male or female part being shaped in a manner to be able to tightly adapted to said respective female part or male part in a first shape-memory state and to be able to ensure the disengagement of said respective female part or male part in a second shape-memory state, said male part or female part being constituted by a shank intended to receive at least one conductive cable, and an active part, fixed to said shank, constituting said male part or female part, and intended to ensure certain contact on said complementary corresponding female part or male part, wherein said shank intended to receive at least one conductive cable has at least one shape-memory state, said shank being shaped in a manner to be able to be tightly adapted to the conductor cable in said shape-memory state in order to ensure electric connection with this latter.

12. An electric connector according to claim 1, wherein said shape-memory material is chosen from the group of compositions nickel-titanium, copper-zinc-aluminum, copper-aluminum-nickel, nickel-titanium-iron, nickel-aluminium.

13. An electric connector according to claim 12, wherein said materials are used in the form of intermetallic compositions or in alloyed form.

14. An electric connector according to claim 1, wherein each said male or female part has a conductive protective covering.

* * * * *